US010399578B2

(12) United States Patent
Fenayon et al.

(10) Patent No.: US 10,399,578 B2
(45) Date of Patent: Sep. 3, 2019

(54) RAILCAR ADAPTER FOR CONNECTING A RAILCAR BODY TO A BEARING

(71) Applicants: Ludovic Fenayon, Montbazon (FR); Thierry Le Moigne, Luynes (FR)

(72) Inventors: Ludovic Fenayon, Montbazon (FR); Thierry Le Moigne, Luynes (FR)

(73) Assignee: Aktiebolaget SKF, Göteborg (SE)

( * ) Notice: Subject to any disclaimer, the term of this patent is extended or adjusted under 35 U.S.C. 154(b) by 225 days.

(21) Appl. No.: 15/341,592

(22) Filed: Nov. 2, 2016

(65) Prior Publication Data

US 2017/0137040 A1 May 18, 2017

(30) Foreign Application Priority Data

Nov. 13, 2015 (EP) ..... 15306797

(51) Int. Cl.

| | |
|---|---|
| ***B61F 5/26*** | (2006.01) |
| ***B61F 15/06*** | (2006.01) |
| ***B61F 5/32*** | (2006.01) |
| ***B61F 15/12*** | (2006.01) |
| ***B61F 15/22*** | (2006.01) |

(52) U.S. Cl.

CPC ..... *B61F 5/26* (2013.01); *B61F 5/32* (2013.01); *B61F 15/06* (2013.01); *B61F 15/12* (2013.01); *B61F 15/22* (2013.01)

(58) Field of Classification Search

CPC ..... B61F 15/06; B61F 15/12; B61F 15/22; B61F 5/26; B61F 5/32; B61F 15/00; B61F 15/02; B61F 15/20

See application file for complete search history.

(56) References Cited

U.S. PATENT DOCUMENTS

| | | | | |
|---|---|---|---|---|
| 5,794,538 | A | 8/1998 | Pitchford | |
| 5,799,582 | A | 9/1998 | Rudibaugh et al. | |
| 7,775,163 | B2 * | 8/2010 | Forbes | B61F 5/30 105/224.1 |
| 8,893,626 | B2 * | 11/2014 | Berg | B61F 5/305 105/220 |
| 2014/0318412 | A1 * | 10/2014 | East | B61F 5/28 105/218.1 |
| 2015/0183442 | A1 | 7/2015 | Gotlund et al. | |

FOREIGN PATENT DOCUMENTS

| | | | |
|---|---|---|---|
| DE | 10 2008 060 752 | * | 6/2010 |
| EP | 0825084 | A2 | 2/1998 |
| WO | 2005005219 | A2 | 1/2005 |

* cited by examiner

*Primary Examiner* — Mark T Le
(74) *Attorney, Agent, or Firm* — Bryan Peckjian; SKF USA Inc. Patent Dept.

(57) ABSTRACT

A railcar adapter for connecting a railcar body to a bearing is provided. The railcar adapter includes an adapter body having two lateral channels each delimited by a pair of opposed lugs adapted to cooperate with the railcar body, an inner surface acting as a bearing seat for the bearing and an outer surface in radial contact with the railcar body. The inner surface includes at least one central groove located on a first axis of symmetry of the railcar adapter emerging in each lateral channel. The inner surface further provides a second central groove located on a second symmetry axis of the railcar adapter, perpendicular to the first symmetry axis.

10 Claims, 3 Drawing Sheets

RAILCAR ADAPTER FOR CONNECTING A RAILCAR BODY TO A BEARING

CROSS REFERENCE TO RELATED APPLICATIONS

This application claims priority to European patent application no. 15306797.0 filed on 13 Nov. 2015, the contents of which are fully incorporated herein by reference.

FIELD OF THE INVENTION

The present invention relates to the field of bearing adapters for a railcar.

BACKGROUND OF THE INVENTION

A railcar generally provides a pair of side frames on each side having downwardly opening jaws. A bearing adapter is vertically moveable within the jaw and rests on a bearing mounted on a railcar axle carrying a wheel of the railcar. The bearing adapter is thus a rigid connection between the bogie frame of the railcar and the bearing. Typically, a bearing for a railcar axle fits around a journal at the end of the railcar axle where it is mounted between a backing ring assembly and an end cap.

Due to limited bearing support surface, the load applied on the bearing by the railcar adapter is not well distributed on the bearing, notably on the rolling elements when the bearing is of the rolling bearing type. This results in wear on the inner surface and the outer surface of the railcar adapter, as well as in failure of the bearing.

In order to improve the load distribution on the bearing, the outer surface of the railcar adapters is provided with a central groove extending in an axis parallel to the bearing rotational axis.

BRIEF SUMMARY OF THE INVENTION

Therefore, it is an object of the invention to reduce the load applied on the bearing by the railcar adapter by optimizing the contact surface between the bearing and the railcar adapter.

In one embodiment a railcar adapter for radially connecting a railcar body to a bearing, provides an adapter body having two lateral channels each delimited by a pair of opposed lugs and a lateral surface perpendicular to the opposed lugs. Each lateral channels are adapted to cooperate with the railcar body. The adapter body provides an inner surface acting as a bearing seat for the bearing and an outer surface in radial contact with the railcar body. The inner surface provides at least one central groove located on a first axis of symmetry of the railcar adapter emerging in each lateral channel.

The first central groove allows avoiding contact of the railcar adapter on the edges of a groove provided on the outer cylindrical surface of the outer ring of the bearing.

The inner surface is provided with a second central groove located on a second symmetry axis of the railcar adapter, perpendicular to the first symmetry axis.

Thanks to the second central groove, the railcar adapter is in direct radial contact with the bearing only on the sides of the bearing and not in its centre. The load distribution on the bearing, notably on the rolling elements, is thus significantly improved.

In one embodiment, the inner surface is provided with two lateral grooves parallel to the first central groove and perpendicular to the second central groove, the second central groove emerging in both lateral grooves.

Thanks to the two lateral grooves, there is no contact of the railcar adapter on the edges of the bearing.

Advantageously, the outer surface is provided with an upper central groove extending along an axis parallel to the second central groove. Such upper central groove is optional.

The inner surface has, for example, a concave shape of constant radius so as to sit on the bearing.

The railcar adapter can be made from metal, for example, by casting. For example, the railcar adapter is made from cast steel or cast iron.

According to another aspect, the invention relates to a railcar adapter assembly comprising a railcar adapter as described above, a bearing mounted inside the railcar adapter, a backing ring adapted to come into axial contact with the bearing at a first side, and an end cap assembly adapted to come into axial contact with the bearing at another side, opposite to the first side.

In one embodiment, the bearing provides at least one inner ring and at least one outer ring mounted in radial contact with the inner surface of the railcar adapter.

In one embodiment, the bearing provides at least one row of rolling elements, arranged between raceways provided on the inner and outer rings.

In one embodiment, the inner ring of the bearing is made in two parts, axially separated by an axial spacer.

According to another aspect, the invention relates to railcar axle comprising a railcar adapter assembly as described above, a shaft being rotatably mounted about an axis of rotation relative to a railcar adapter, inside the bearing. The shaft provides a first end mounted radially inside the backing ring and a second end, opposite to the first end, secured to the end cap assembly.

BRIEF DESCRIPTION OF THE SEVERAL VIEWS OF THE DRAWING

Other advantages and features of the invention will emerge upon examining the detailed description of embodiments, which are in no way limiting, and the appended drawings wherein.

DETAILED DESCRIPTION OF THE INVENTION

Figure 1:
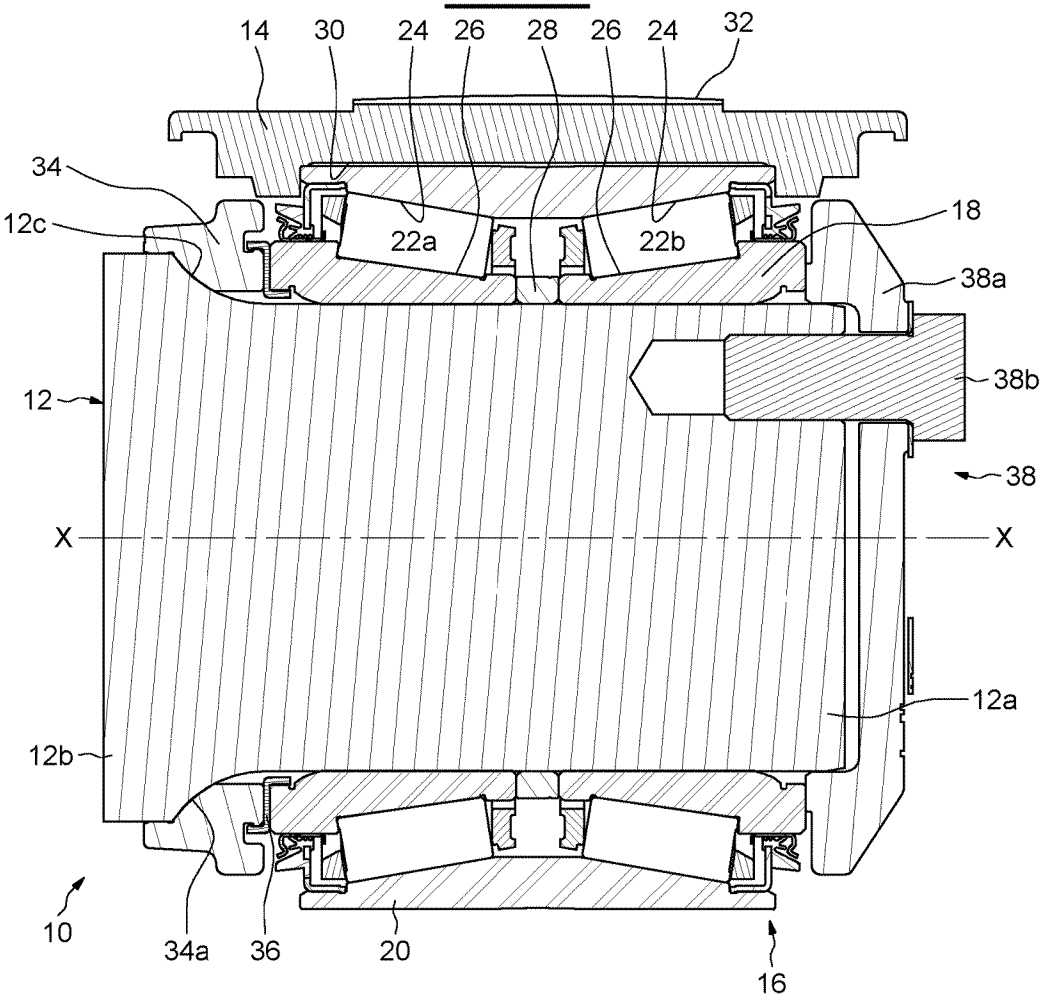
FIG. 1 is an axial cross-section of a railcar axle according to the invention.

Referring to FIG. 1, a railcar axle 10 is provided for binding the bogie frame of a railcar to the wheels (not shown). The railcar axle 10 provides a shaft 12, being rotatably mounted about an axis of rotation X-X relative to a railcar adapter 14. The railcar adapter 14 is secured to the railcar bogie frame, the shaft 12 being secured to the wheels.

A bearing 16 is radially provided between the railcar adapter 14 and the shaft 12. As illustrated, the bearing 16 is of the rolling bearing type, and comprises an inner ring 18 mounted on the shaft 12, an outer ring 20 mounted inside the railcar adapter 14 and two rows of rolling elements 22*a*, 22*b*, for example rollers, arranged between raceways 24, 26 provided on the inner and outer rings 18, 20. The inner ring 18 is, for example, made in two parts, axially separated by an axial spacer 28. In this embodiment, the bearing 16 is a tapered rollers bearing.

The railcar adapter 14 is secured to the outer ring 20 by its radially inward side or bearing seat side 30 and is mounted inside the bogie frame by its radially outward side or frame seat side 32.

The shaft 12 provides a journal 12*a* and a dust guard having a cylindrical surface 12*b* whose diameter is bigger than the diameter of the journal 12*a*. A concave fillet 12*c* connects the cylindrical surface 12*b* on the journal 12*a*. The inner ring 18 of the bearing is mounted on the journal 12*a*.

As illustrated, the railcar axle 10 further provides a backing ring 34 having an inner surface 34*a* adapted to radially come into contact with the outer surface of the shaft 12, at the fillet 12*c* side and to axially come into contact with the inner ring 18 of the bearing 16, through a sealing means 36. Accordingly, the inner surface 34*a* has a rounded shape, almost complementary to that of the fillet 12*c*.

The railcar axle 10 also provides an end cap assembly 38. The end cap assembly 38 includes an end cap 38*a* provided for being a stop element in case of a leftward translation (relative to FIG. 1) of the shaft 12 relative to the inner ring 18. Therefore, the end cap 38*a* is reliably secured to the journal 12 by means of three cap screws 38*b* and comes in axial contact with the inner ring 18 of the bearing 16.

Figure 2:
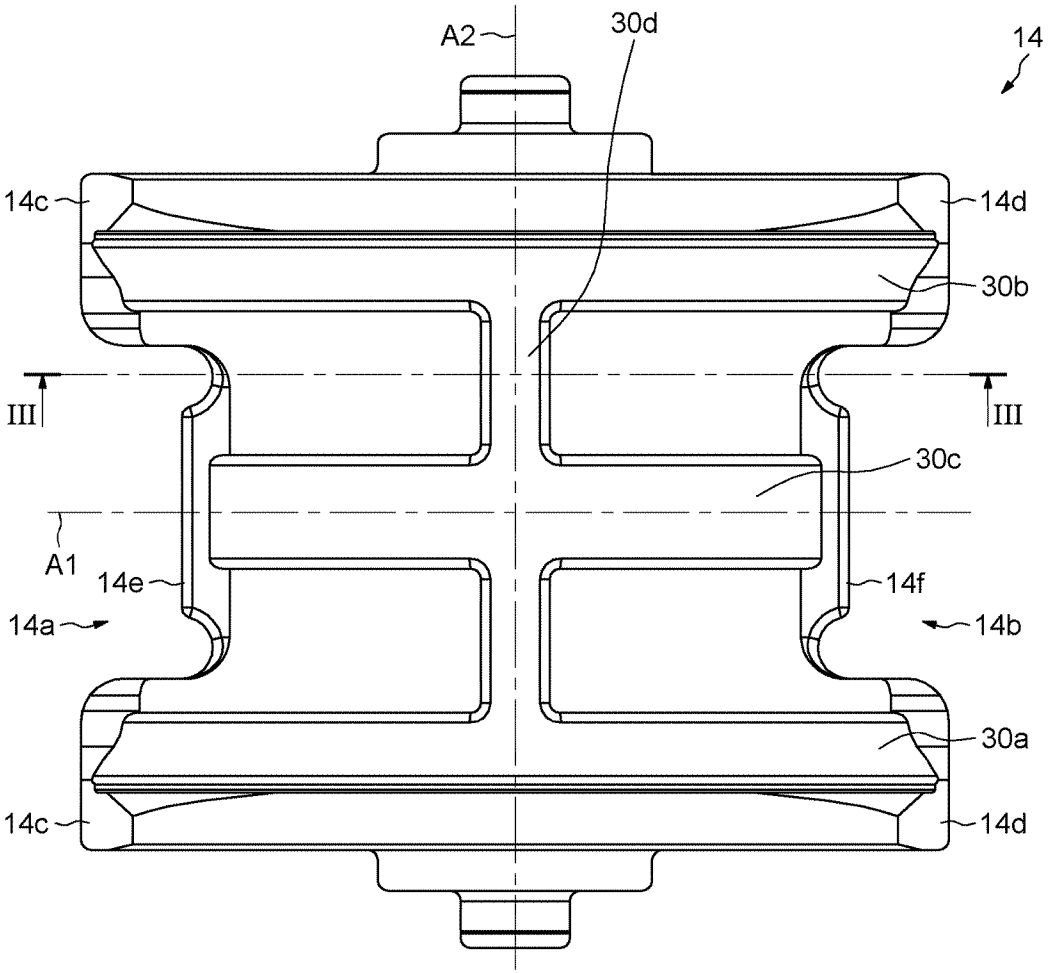
FIG. 2 is a view of the inside of the railcar adapter of FIG. 1.
Figure 3:
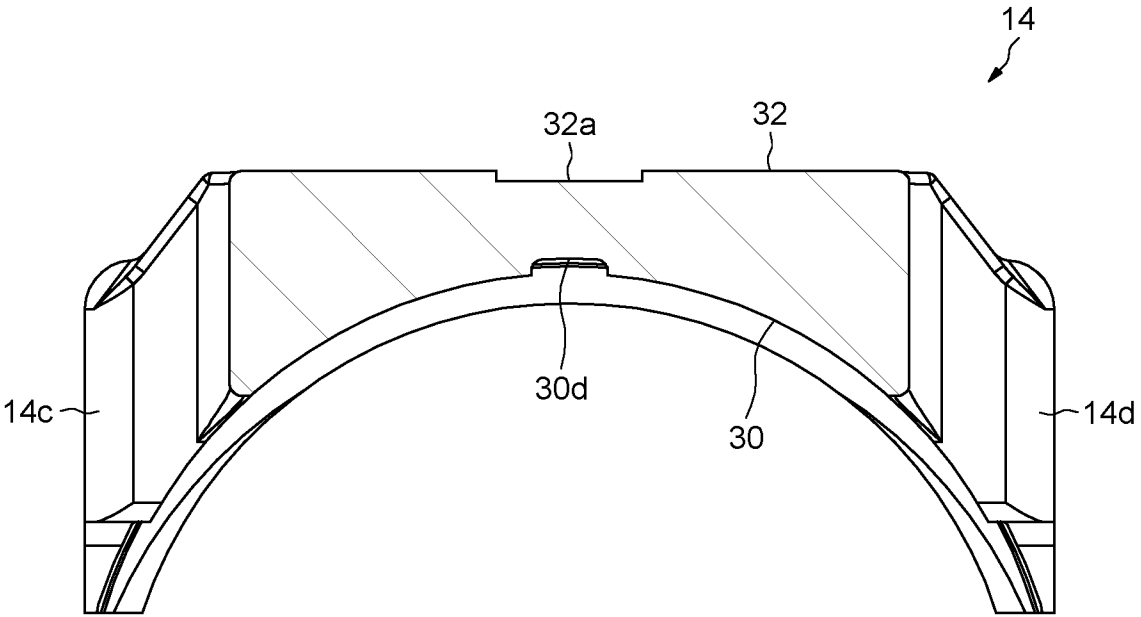
FIG. 3 is a cross-section along axis III-III of FIG. 2.

As illustrated in detail on FIGS. 2 and 3, the railcar adapter 14 provides two lateral channels 14*a*, 14*b* each axially delimited by a pair of opposed lugs 14*c*, 14*d* and a lateral surface 14*e*, 14*f* perpendicular to the opposed lugs 14*c*, 14*d*. Each lateral channel 14*a*, 14*b* has a U-shape and is adapted to engage with a lug of a jaw (not shown) of the bogie frame, so as to act as an insertion guide between the adapter and the bogie frame.

The body of the railcar adapter 14 further provides an inner surface 30 in radial contact with the outer ring 20 of the bearing 16 and an outer surface 32 in radial contact with the bogie frame.

The outer surface 32 is provided with an upper central groove 32*a* extending along an axis parallel to the axis of rotation X-X of the bearing 16. The upper central groove 32*a* is optional.

The inner surface 30 has a concave shape of constant radius so as to sit on the outer cylindrical surface of the outer ring 20 of the bearing 16. As illustrated, the inner surface 30 is provided with two lateral grooves 30*a*, 30*b* extending along an axis perpendicular to the axis of rotation X-X of the bearing 16 in order to avoid contact of the railcar adapter on the edges of the bearing 16. The inner cylindrical surface 30 further provides a first central groove 30*c* located on a first symmetry axis $A_1$ of the railcar adapter 14. The first central groove 30*c* extends along an axis perpendicular to the axis of rotation X-X of the bearing and emerges in each lateral channel. The first central groove 30*c* allows avoiding contact of the railcar adapter 14 on the edges of a groove (not shown) provided on the outer cylindrical surface of the outer ring 20.

The inner surface 30 is further provided with a second central groove 30*d* located on a second symmetry axis $A_2$ of the railcar adapter 14, which is parallel to the axis of rotation X-X of the bearing 16. The second symmetry axis $A_2$ of the railcar adapter 14 is perpendicular to the first symmetry axis $A_1$. The second central groove 30*d* emerge in both lateral grooves 30*a*, 30*b*.

Thanks to the second central groove 30*d* made on the inner surface 30 of the railcar adapter 14, the load distribution exerted by the bogie frame on the to the rolling elements 22*a*, 22*b* of the bearing 16 through the outer surface 32 of the railcar adapter 14 is improved.

The two lateral grooves, and the two central grooves are connected so as to form one channel.

The railcar adapter 14 is made from metal by any suitable process, such as, for example, by casting. For example, the railcar adapter 14 is made from steel or cast iron.

Thanks to the present invention, the load distribution on the bearing is improved. The wear of the railcar adapter is thus significantly reduced, and the service life of the bearing is increased.

It should be noted that the embodiments, illustrated and described were given merely by way of non-limiting indicative examples and that modifications and variations are possible within the scope of the invention.

The invention has been illustrated on the basis of a rolling bearing provided with at least one row of rolling elements radially disposed between the inner and outer rings. Alternatively, the bearing may be a plain bearing or a sliding bearing comprising one or two rings.

The invention claimed is:

1. A railcar adapter, for connecting a railcar body to a bearing having a bearing axis of rotation, the railcar adapter comprising:

an adapter body defining two lateral channels each extending parallel to the bearing axis of rotation and each delimited by a pair of opposed lugs, and each of the two lateral channels are defined by a curvilinear portion of the adapter body which terminates in a lateral surface perpendicular to the opposed lugs, each of the two lateral channels being adapted to cooperate with the railcar body, the adapter body having an inner surface acting as a bearing seat for the bearing, and wherein the curvilinear portion of the adapter body which defines each of the two lateral channels forms a recess inwardly into the inner surface and defines a curvature such that the curvilinear portion joints a portion of a side of the lateral channel perpendicular to the lateral surface, wherein the curvilinear portion does not reduce lateral thickness of an adjacent one of the opposed lugs;

an outer surface in radial contact with the railcar body, the inner surface having at least one central groove located on a first axis of symmetry (A1) of the railcar adapter emerging in each lateral channel, the at least one central groove extending circumferentially around the bearing and being perpendicular to the two lateral channels;

wherein the inner surface is provided with a second central groove located on a second symmetry axis (A2) of the railcar adapter, perpendicular to the first symmetry axis (A1), the second central groove being parallel to the two lateral channels and being configured such that while the adapter body is in direct radial contact with the bearing, the adapter body does not centrally contact the bearing.

2. The railcar adapter according to claim 1, wherein the inner surface is provided with two lateral grooves parallel to the first central groove and perpendicular to the second central groove, the second central groove emerging in both lateral grooves.

3. The railcar adapter according to claim 1, wherein the outer surface is provided with an upper central groove extending along an axis parallel to the second central groove.

4. The railcar adapter according to claim 1, wherein the inner surface has a concave shape of constant radius so as to sit on the bearing.

5. The railcar adapter according to claim 1, wherein the railcar adapter is made from metal.

6. The railcar adapter according to claim 5, wherein the railcar adapter is made from one of cast steel and cast iron.

7. A railcar adapter assembly comprising:

the railcar adapter of claim 1, a bearing mounted inside the railcar adapter, a backing ring adapted to come into axial contact with the bearing at a first side, and an end cap assembly adapted to come into axial contact with the bearing at a second side, opposite to the first side.

8. The railcar adapter assembly according to claim 7, wherein the bearing provides at least one inner ring and at least one outer ring mounted in radial contact with the inner surface of the railcar adapter.

9. The railcar adapter assembly according to claim 8, wherein the bearing provides at least one row of rolling elements, arranged between raceways provided on the inner and outer rings.

10. The railcar adapter assembly according to claim 8, wherein the inner ring of the bearing is made in two parts, axially separated by an axial spacer.

* * * * *